United States Patent [19]

Camosso et al.

[11] Patent Number: 4,640,238

[45] Date of Patent: Feb. 3, 1987

[54] OILTIGHT HYDRAULIC TAPPET FOR CONTROLLING AN INTERNAL COMBUSTION ENGINE VALVE

[75] Inventors: Domenico Camosso; Franco Colanzi, both of Turin; Silvio Ragazzoni, Pino Torinese, all of Italy

[73] Assignee: RIV-SKF Officine di Villar Perosa S.p.A., Italy

[21] Appl. No.: 752,949

[22] Filed: Jul. 8, 1985

[30] Foreign Application Priority Data

Jul. 16, 1984 [IT] Italy ..... 67715 A/84

[51] Int. Cl.[4] ..... F01L 991/24

[52] U.S. Cl. ..... 123/90.55; 123/90.58

[58] Field of Search ..... 123/90.55, 90.56, 90.57, 123/90.58

[56] References Cited

U.S. PATENT DOCUMENTS 4,279,226 7/1981 Lampredi et al. ..... 123/90.55
4,397,271 8/1983 Gardner ..... 123/90.58
4,463,713 8/1984 Barale ..... 123/90.55

FOREIGN PATENT DOCUMENTS 145445 6/1985 European Pat. Off. ..... 123/90.55
3339773 6/1984 Fed. Rep. of Germany ... 123/90.55
160106 12/1980 Japan ..... 123/90.58

*Primary Examiner*—Ira S. Lazarus
*Attorney, Agent, or Firm*—Jeffers, Irish & Hoffman

[57] ABSTRACT

Hydraulic tappet comprising a cup member, the latter sliding in a seat and housing a second cup member sliding in relation to the first in such a manner as to form a first chamber, and a flexible annular member located essentially inside the said second cup member in such a manner as to form a fluidtight second chamber connected hydraulically to the said first chamber; the said two chambers being filled with activating fluid the flow of which from the said second to the said first chamber being controlled by an on-off member.

5 Claims, 2 Drawing Figures

OILTIGHT HYDRAULIC TAPPET FOR CONTROLLING AN INTERNAL COMBUSTION ENGINE VALVE

BACKGROUND OF THE INVENTION

The present invention relates to a hydraulic tappet designed for assembly on a drive for controlling an internal combustion engine valve.

Hydraulic tappets of the aforementioned type are generally known to comprise a first member, sliding in relation to the engine frame, and a second member sliding axially in relation to the said first member. Between the said two members is formed a chamber varying in volume and having an inlet duct for activating fluid, the opening on the said duct being controlled by an on-off member in such a manner that the said fluid flowing into the said chamber causes one of the said members to move axially in relation to the other so as to vary the volume of the said chamber and so take up any slack on the said drive gear train on the engine.

The said variable-volume chamber normally communicates through ducts with an appropriate source of activating fluid.

A major drawback on tappets of the aforementioned type is that they perform badly when the engine is started up, owing to the fact that the oil inside the said chamber prior to start-up seeps out between the mating surfaces on the said first and second sliding members, and that, during start-up, the oil pressure on the engine is too low to ensure adequate oil supply to the said chamber. On certain known tappets, the aforementioned drawbacks have been partially solved by providing for a second activating fluid chamber communicating hydraulically with the first and designed to store a certain amount of fluid even when the engine is idle, thus enabling the first chamber to be filled with fluid more easily, as compared with the previous arrangement, when the engine is started up.

On these tappets, however, long-term operation of the engine may result in such severe oil leakage from the second chamber as to jeopardize operation of the tappet; such leakage occurring between the mutually-sliding mating surfaces on the said two sliding members, despite the same being provided with appropriate sealing members.

SUMMARY OF THE INVENTION

The aim of the present invention is to provide a hydraulic tappet of the aforementioned type involving none of the aforementioned drawbacks, i.e. one providing for a high degree of reliability, good performance even during start-up, and requiring no maintenance. The tappet according to the present invention is also highly compact, straightforward in design and therefore cheap to make. With this aim in view, the present invention relates to a hydraulic tappet designed for assembly on a drive for controlling a valve on an internal combustion engine, the said tappet comprising a first cup member sliding axially in relation to the engine frame, and a second cup member sliding axially inside the said first member; both said cup members having essentially a respective flat bottom wall and a cylindrical side wall and combining to form a first variable-volume chamber with an inlet duct for activating fluid; the said duct being controlled by an on-off member in such a manner that the said fluid flowing into the said chamber causes one of the said members to slide axially in relation to the other so as to vary the volume of the said chamber; characterised by the fact that it comprises an annular member made of flexible material and arranged essentially inside the said second cup member in such a manner as to form a second annular chamber for the said activating fluid connected hydraulically to the said first chamber via the said duct; the said annular member of flexible material having a first and second annular edge connected in fluidtight manner respectively to the said side wall on the said first cup member and to the said bottom wall on the said second cup member.

The present hydraulic tappet also comprises flexible means designed normally to keep the said annular member of flexible material in a flexed position whereby the volume of the said second chamber is minimum, thus causing the said activating fluid to flow from the said second to the said first chamber.

BRIEF DESCRIPTION OF THE DRAWINGS

The present invention will now be described in more detail by way of a non-limiting example with reference to the attached drawings in which.

DETAILED DESCRIPTION OF THE INVENTION

Figure 1:
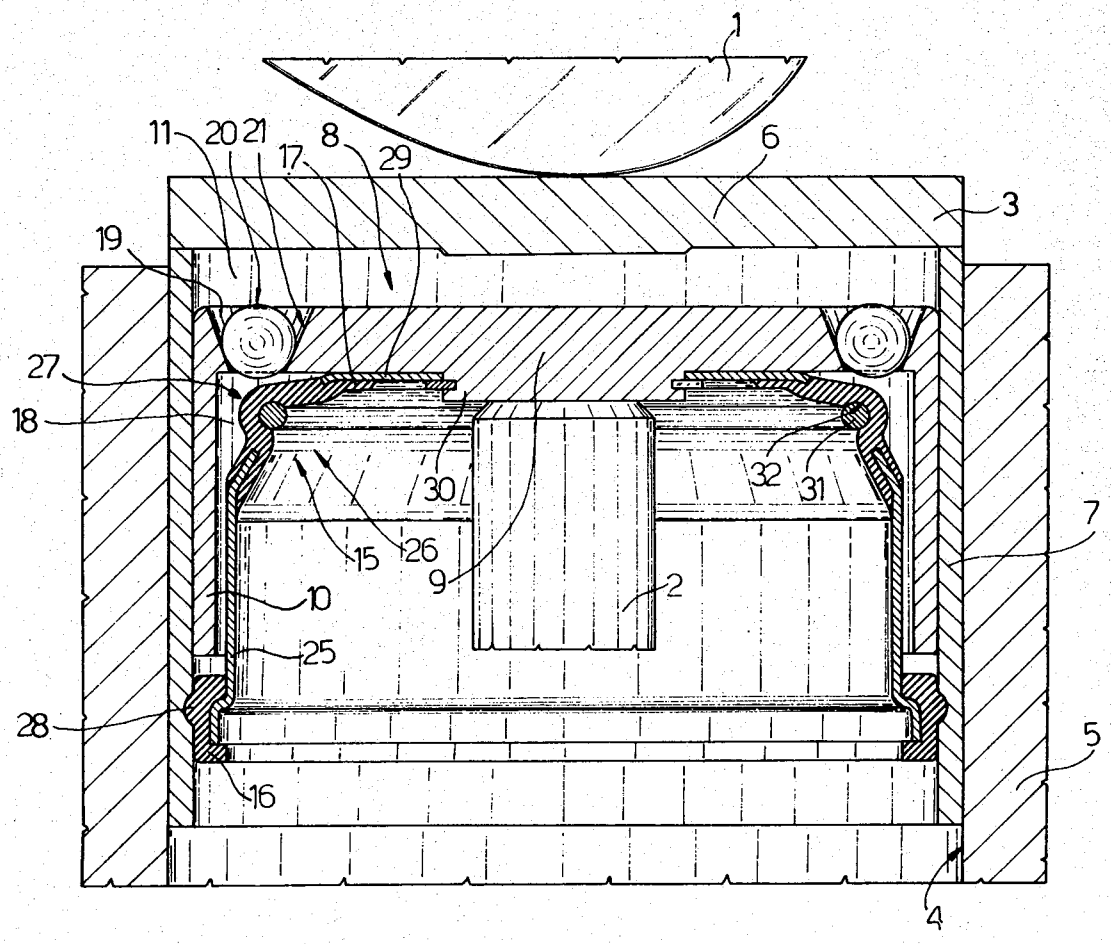
FIG. 1 shows an axial section of the tappet according to the present invention in a first working arrangement.

The tappet according to the present invention is designed for assembly on a drive for controlling a valve on an internal combustion engine. Of the said drive, FIG. 1 merely shows part of control cam 1 and, of the valve, the end part of stem 2.

The tappet according to the present invention essentially comprises a first cup member 3 sliding inside an essentially cylindrical seat 4 formed inside engine frame 5. The said first member 3 comprises an essentially flat bottom wall 6 designed to contact cam 1, and an essentially cylindrical side wall 7 designed to cooperate with the cylindrical surface of seat 4.

The tappet according to the present invention also comprises a second cup member 8 sliding essentially inside the first cup member 3 and also having an essentially flat bottom wall 9 and a cylindrical wall 10 designed to mate with the matching side wall 7 on the said first cup member 3.

Between the said two cup members is formed a first essentially cylindrical chamber 11 for activating fluid. The tappet according to the present invention also comprises an annular member 15 made of flexible material, arranged inside the said second cup member 8 and having two annular edges, one of which 16 is connected in fluid-tight manner on to the inner surface of side wall 7 on first cup member 3, whereas the second 17 is connected, also in fluidtight manner, to the bottom wall 9 on second cup member 8. In like manner, annular member 15, together with side walls 7 and 10 on cup members 3 and 8 and with bottom wall 9 on cup member 8, defines a second fluid chamber 18 communicating with the first via a hole 19 formed in bottom wall 9 on second cup member 8 and controlled by on-off member 20. The latter may conveniently consist of a ball designed to cooperate with a matching taper seat 21 in hole 19. As shown clearly on the attached drawings, the lines generating the tapered surface of seat 21 converge in the direction of second chamber 18, thus enabling ball 20 to rest inside the seat and prevent fluid from flowing through the same when the pressure inside first chamber 8 is higher than in second chamber 18.

The said annular member of flexible material conveniently comprises an essentially cylindrical first part 25, having annular edge 16, and a second part 26 connected to the first and having second edge 17. The said second part 26 presents at least one circumferential rib 27 and is made of flexible material, such as rubber. The said first part 25, on the other hand, is made of more rigid material, e.g. metal, in which case the material of part 26 may be vulcanized directly or secured in any other manner to that of first part 25. If the latter part of annular member 15 is made of metal, provision is made between the said part 25 and side wall 7 on first cup member 3, for a ring of sealing material 28 for sealing between the said wall 7 and part 25. The second annular edge 17 on second part 26 of flexible annular member 15 is conveniently connected by means of a metal ring 29 the outermost edge of which is secured to an essentially cylindrical projection 30 on wall 9, and the innermost edge of which is connected in any convenient manner, e.g. by vulcanizing it to a matching annular edge on second part 26.

Inside flexible annular member 15, provision is made for flexible means designed normally to keep the said annular member in a flexed position (FIG. 1) whereby the volume in the said second chamber is minimum, thus causing fluid to flow from the second to the first chamber. The said flexible means may conveniently consist of an annular spring 31 housed essentially inside a respective seat 32 on second part 26 of member 15 and designed to exert essentially radial pressure on the said part 26 so as to move the latter from the FIG. 2 into the FIG. 1 position.

The tappet according to the present invention operates as follows.

Figure 2:
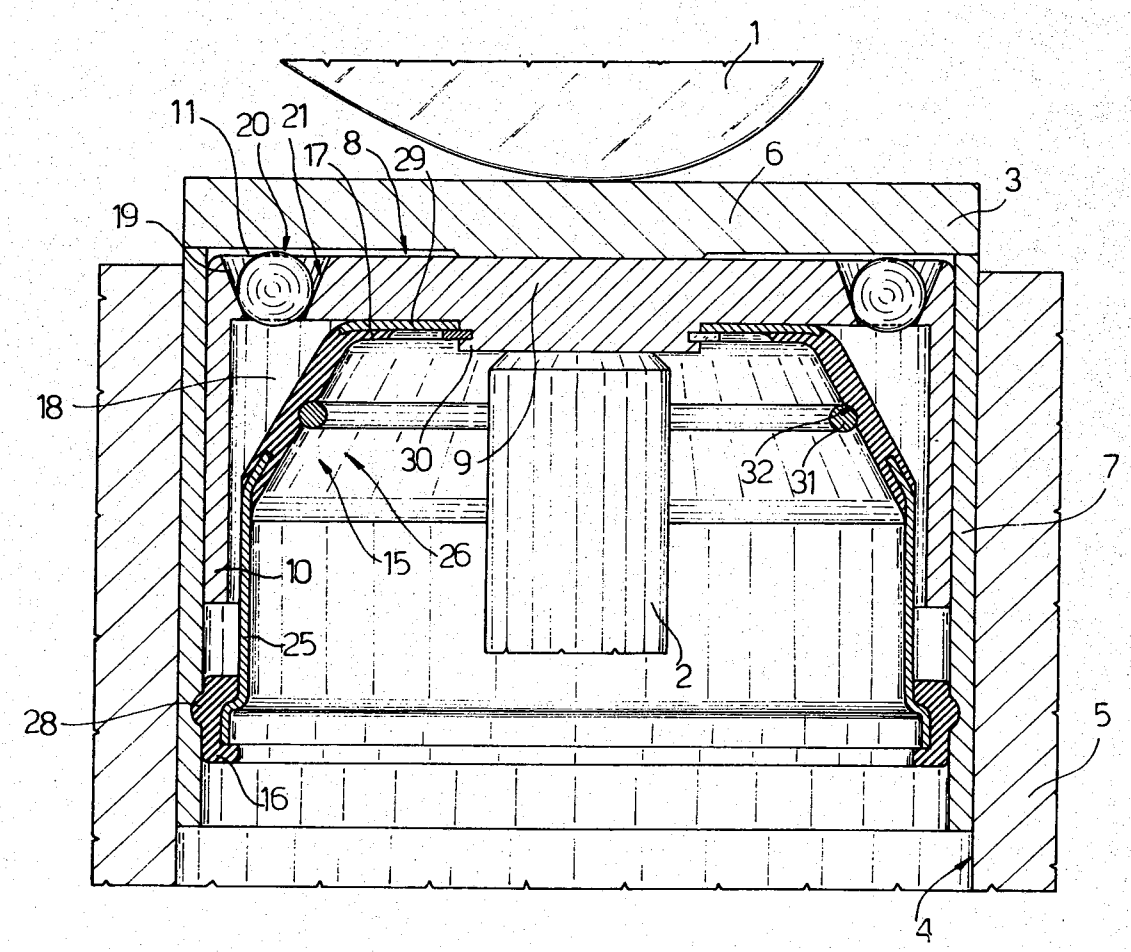
FIG. 2 shows the FIG. 1 tappet in a second working arrangement.

At the manufacturing stage, the first and second chambers, 11 and 18, on the tappet are filled up with oil, presumably with the tappet arranged as shown in FIG. 2, i.e. maximum volume inside second chamber 18.

When the engine is started up with the tappet assembled on the gear train between cam 1 and stem 2, there is an immediate tendency for any slack between the tappet and other components to be taken up, owing to the oil inside second chamber 18 being kept under pressure by spring 31 and therefore tending to flow back through hole 19 into first chamber 11 which is filled up until first cup member 3 contacts cam 1.

When the engine is running, the oil inside first chamber 11 is prevented from flowing back through hole 19 by ball 20 being thrust against seat 21 so as to close off the hole, thus eliminating any slack between cam 1 and stem 2 while the engine is running. When the engine is left idle for relatively long periods, oil may seep between mating side walls 7 and 10 on first and second cup members 3 and 8 respectively, thus enabling oil to flow back from first chamber 11 into second chamber 18. As soon as the engine is started up, however, and even during the initial operating period with the oil pressure still low, any slack on the drive is efficiently taken up by the tappet owing to the oil pressure inside second chamber 18 being sufficiently high for oil to flow back through hole 19 into first chamber 11 and so establish contact between bottom walls 6 and 9 and cam 1 and stem 2 respectively.

Clearly, therefore, the tappet according to the present invention provides for correct operation even at low engine speed or just after start-up, in that the oil pressure inside second chamber 18 is always sufficient for oil to flow into first chamber 11. The tappet according to the present invention also provides for maximum reliability in that the hydraulic conditions established during manufacture remain essentially unchanged during operation. Any possibility of oil leakage from the tappet is safe-guarded against by none of the sliding connections communicating externally, but only with second oil chamber 18. Furthermore, the design of the tappet according to the present invention is straightforward and compact, thus enabling low-cost manufacture.

To those skilled in the art it will be clear that changes may be made to the arrangement shown without, however, departing from the scope of the present invention.

Firstly, the shape of flexible annular member 15 may be other than as described, and different flexible means may be provided for exerting radial pressure for flexing the said member and so keeping the fluid in chamber 18 essentially under pressure.

Secondly, the on-off means between the said two chambers may be other than as described. Thirdly, provision may conveniently be made, between bottom walls 6 and 9 on the said two cup members, for any type of spring, e.g. a flat spring, for parting the said walls and setting them in the mutual position shown in FIG. 1.

We claim:

1. A hydraulic tappet for controlling a valve of an internal combustion engine, the said tappet comprising a first cup member axially slidingly disposed in relation to the engine frame, and a second cup member axially slidingly disposed inside the said first cup member; each said cup member having a respective substantially flat bottom wall and a cylindrical side wall, said cup members cooperating to form a first variable-volume chamber with an inlet duct for activating fluid; the said duct being controlled by an on-off member in such a manner that the said fluid flowing into the said first chamber causes one of the said cup members to slide axially in relation to the other cup member so as to vary the volume of the said chamber; characterised by the fact that said tappet further comprises an annular member made of flexible material and arranged essentially inside the said second cup member in such a manner as to form a second annular chamber for the said activating fluid, said second chamber connected hydraulically to the said first chamber via the said duct; the said annular member of flexible material having first and second annular edges connected in fluidtight manner respectively to the said side wall of the said first cup member and to the said bottom wall of the said second cup member and resilient means for urging said flexible annular member into a flexed position, whereby the volume of said second chamber is minimized, thereby causing activating fluid to flow from said second chamber to said first chamber.

2. The hydraulic tappet according to claim 1, characterised by the fact that the said resilient means comprises at least one annular spring located inside the said flexible annular member, said spring exerting radial pressure on an outer surface of the said flexible annular member thereby urging said flexible member into said flexed position.

3. The hydraulic tappet according to claim 1, characterised by the fact that the said duct enabling the said fluid to flow into the said first chamber comprises a hole formed in the said bottom wall of the said first cup member, and that the said on-off member comprises a ball for cooperating with a valve seat portion of the said hole to prevent flow of fluid into said first chamber.

4. The hydraulic tappet according to claim 1, characterised by the fact that the said flexible annular member includes at least one circumferential rib for enabling the said flexible member to move into said flexed position wherein the volume in the said second chamber is minimized.

5. The hydraulic tappet according to claim 1, characterised by the fact that the said first annular edge is secured to a substantially cylindrical first part of said flexible annular member, said flexible annular member including a second part having at least one circumferential rib, said second part connected to the said first part and said second annular edge connected to the said bottom wall of the said second cup member the said first part being made of more rigid material than the said second part.

* * * * *